US005201673A

United States Patent [19]

Minezawa et al.

[11] Patent Number: 5,201,673

[45] Date of Patent: Apr. 13, 1993

[54] WIRING CONNECTION STRUCTURE FOR A VEHICLE MOTOR

[75] Inventors: Yukihiro Minezawa, Tokyo; Satoru Wakuta, Anjo, both of Japan

[73] Assignee: Aisin AW Co., Ltd., Japan

[21] Appl. No.: 690,837

[22] Filed: Apr. 24, 1991

[51] Int. Cl.[5] ..... H01R 13/74

[52] U.S. Cl. ..... 439/559; 439/550

[58] Field of Search ..... 439/559, 550, 564, 573, 439/589

[56] References Cited

U.S. PATENT DOCUMENTS

| | | | |
|---|---|---|---|
| 3,161,249 | 7/1962 | Bouladon et al. | 180/10 |
| 3,719,918 | 3/1973 | Kerr | 439/559 |
| 3,812,928 | 5/1974 | Rockwell et al. | 180/65 |
| 3,897,843 | 8/1975 | Hapemen et al. | 180/65 |
| 3,933,217 | 1/1976 | Eichinger | 180/70 |
| 4,799,564 | 1/1989 | Iijima et al. | 180/65 |
| 4,930,590 | 6/1990 | Love et al. | 180/55 |

FOREIGN PATENT DOCUMENTS 2220178 4/1990 United Kingdom .

*Primary Examiner*—Gary F. Paumen
*Attorney, Agent, or Firm*—Lorusso & Loud

[57] ABSTRACT

A wiring connection structure for a vehicle electric motor includes a plug member attached to a casing of the motor, and a socket member which is inserted into a support member fixed to the casing and is fitted into the plug member. The plug member includes a plug connected to internal wiring located in the casing, a plug guide for holding the plug, a rubber bushing for sealing the interior of the casing and a plug cover. The socket member includes a socket connected to wiring external to the motor casing and a socket tube for holding the socket.

3 Claims, 6 Drawing Sheets

WIRING CONNECTION STRUCTURE FOR A VEHICLE MOTOR

BACKGROUND OF THE INVENTION

1. Field of the Invention

The present invention relates to a wiring connection structure for a vehicle motor used in an electric automobile.

2. Description of the Prior Art

In recent years, in view of environmental problems, electric automobiles have been extensively developed. One type has wheel motors with each motor directly connected to a corresponding wheel through a reduction gear. Since this type employs driving sources which are associated with individual wheels, respectively, each wheel can pivot through 90 degrees both in the right and left directions with respect to the direction of straight advance, and thus provides advantageous functions such as a small turning radius and parallel movement.

For actuating the wheel motors, a battery and a control device on a vehicle body are connected to the motors through power wiring and control wiring. In the prior art, these wirings are extended from rear surfaces of the wheel motors through a lower part of the body to an upper part of the body. Further, the wirings are connected to the motor casings by means of connectors attached to the casings.

However, the above arrangement, in which the wirings are extended from the rear surfaces of the wheel motors through the lower part of the body to the upper part of the body, creates a problem it that it requires lengths for the wirings to allow for the wheels moving laterally and vertically. This problem is particularly evident in a case where the wheels are adapted to pivot through 90 degrees in both the right and left directions with respect to the straight ahead direction. Further, the extra lengths of wiring may interfere with the suspension and/or contact the road surface when the wheels are in the straight ahead positions. In order to prevent such problems, the wirings must be supported by appropriate means such as elastic hooks.

In the foregoing type of connection to the wheel motors only a short distance and little space are left between the coil of each motor and the connector and, accordingly, the operation of making a connection between the coil and the connector is difficult, and further there is a problem with respect to sealing for preventing ingress of water and other material into the wheel motor.

Accordingly, it is an object of the invention to provide a wiring connection structure for a vehicle motor, overcoming the above-noted problems, in which the wiring is not required to have an extra length, and thus neither interferes with the suspension nor contacts with the road surface, and easy assembly and good water sealing can be achieved.

SUMMARY OF THE INVENTION

A wiring connection structure for a vehicle motor according to the invention comprises a plug member (27) attached to a casing (13) of a motor and a socket member (29) which is inserted into a support member (9) fixed to the casing and is fitted into the plug member. The plug member (27) includes a plug (33) connected to internal wiring (23*a*) located in the casing. A plug guide (35) receives the plug and a rubber bushing (37) and a plug cover (39) seal the interior of the casing. The socket member (29) includes a socket (50) connected to external wiring (23*b*) and a socket tube (51) for holding the socket.

According to the present invention, for example, as shown in FIG. 1, the plug (33) is fitted and soldered to the internal wiring (23*a*) or each of the internal wires (23*a*) is inserted into and held by the plug guide (35), so that the assembling can be easily carried out even if the wiring in the casing (13) has a short length.

The socket (50) is maintained waterproof by resin (52) and an O-ring (55), and the casing (13) is maintained waterproof an O-ring (31) and a rubber bushing (37).

Further, since the wiring (23) extends through the pivot (9) provided for steering operation of the wheel motor (12), the wiring is only required to have slack or an extra length sufficient to allow for vertical movement of the wheel, and is not required to have slack to allow for lateral movement of the wheel. Therefore, the wiring is not required to have an excessive length, and the interference with the suspension and contact with the road surface can be prevented.

It should be noted that reference numbers are provided only for reference to the drawings, and are not intended to restrict the definition of the invention.

These and other objects and features of the invention will become more apparent from the following description of preferred embodiments with reference to the accompanying drawings.

DETAILED DESCRIPTION OF THE PREFERRED EMBODIMENTS

Figure 2:
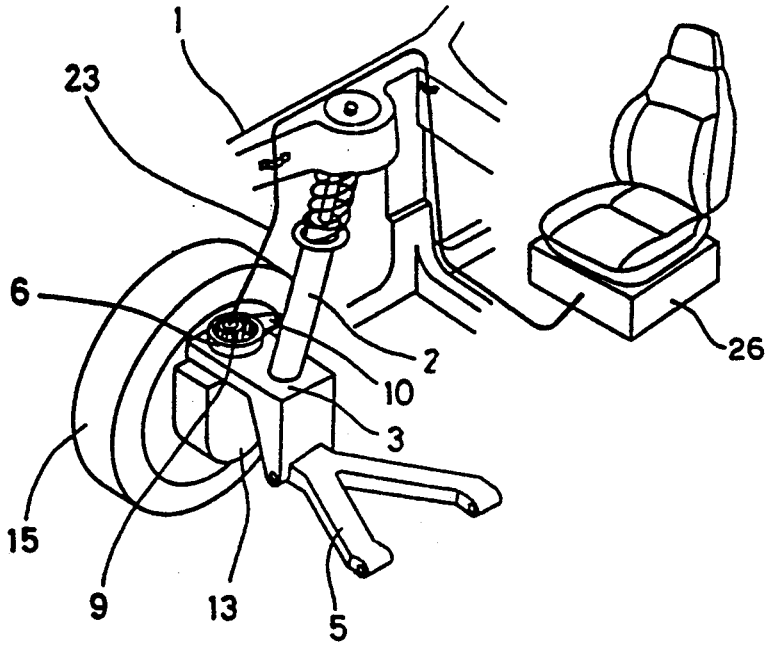
FIG. 2 is a perspective view illustrating an arrangement of a vehicle motor to which the invention is applied.
Figure 3:
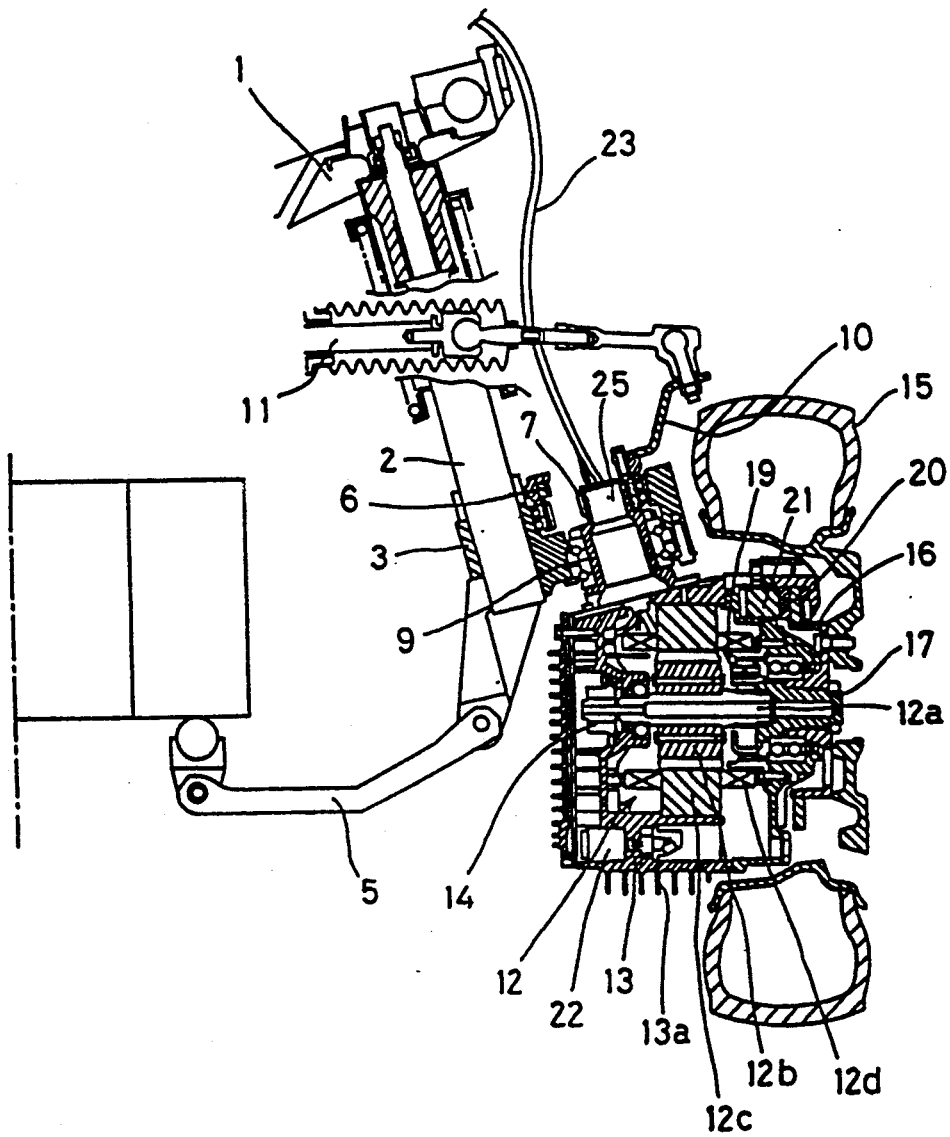
FIG. 3 is a cross section illustrating specific structures of the arrangement in FIG. 2.

Referring to FIGS. 2 and 3, a wheel support member 3 is connected to a vehicle frame 1 through a damper 2, and a lower arm 5 is pivotably supported on the wheel support member 3 so as to absorb vertical movement of a wheel 15.

The wheel support member 3 rotatably supports an internal gear 6 and a pivot 9, which has an external gear 7 meshing with the internal gear 6, through respective bearings. A steering arm or knuckle arm 10 is fixed to the internal gear 6 and is connected to a tie rod 11. The above-mentioned pivot 9 is fixed at an upper surface of a casing 13 of a wheel motor 12. When a steering wheel (not shown) is turned, it turns the knuckle arm 10 through the tie rod 11, and the turning angle is increased by the internal and external gears 6 and 7. In this manner wheel 15 supported by the casing 13 can be pivoted through 90 degrees in both the right and left directions with respect to the straight ahead direction.

Now, the wheel motor 12 will be discussed in detail. The casing 13 has a two-piece structure and is provided at its outer surface with a large number of cooling fins 13a. The wheel motor 12 is housed in the casing 13 in such a manner that a rotary shaft 12a thereof is supported at its one end by a bearing disposed at the side wall of the casing 13. A rotor 12b of the wheel motor 12 is fixed on the rotary shaft 12a, and a stator 12c, around which a coil 12d is wound, is fixed at an inner wall of the casing 13 in an opposed relationship to the rotor 12b. A motor rotational position detector 14 is disposed on the outer wall of the casing 13, and is fixed to the rotary shaft 12a.

The side wall of the casing 13 rotatably supports a wheel hub 16 through a bearing. An output rotary shaft 1 is splined onto the wheel hub 16, and an epicyclic reduction gear 19 is disposed between the output rotary shaft 17 and the rotary shaft 12a. A brake disk 20 is splined onto the wheel hub 16, and a hydraulic piston 21 is provided for pressing the disk 20 toward the casing 13. An oil pump motor 22 is attached to a lower part of the casing 13 so as to circulate oil for cooling the wheel motor 12.

In the invention, the wirings 23 for the coil 12d, motor rotational position detector 14 and oil pump motor 22 are extended from the interior of the casing 13 through a connector 25 arranged inside the pivot 9 toward the vehicle frame 1, and are connected to a control device 26 (See FIG. 2). Lengths of the wirings 23 between the connector 25 and the vehicle frame 1 are provided with an amount of slack which allows for the maximum possible vertical movement of the vehicle body.

Since the wirings 23 are extended through the pivot 9 which provides for steering operation of the wheel motor 12, the wirings are required to have slack or extra length which allows only for the vertical movement of the wheel, and are not required to have additional slack to allow for the lateral movement of the wheel. Therefore, the wirings are not required to have excessive lengths, and thus interference with the suspension and the contact with the road surface can be prevented.

Now, the wiring connection structure for the vehicle motor of the invention will be described below with reference to FIG. 1.

The above-mentioned connector 25 is formed of a plug member 27 fixed to the casing 13 and a socket member 29 inserted into the pivot 9. A mounting plate 30 is welded to the pivot 9 and is fixed to the casing 13 by bolts 32 with an O-ring 31 therebetween.

The plug member 27 includes internal wirings 23a connected to the coil 12d, the motor rotational position detector 14 and the oil pump motor 23 as well as plugs 33 fitted and soldered to the respective internal wirings 23a, a plug guide 35 (FIG. 7), a C-ring 36 (FIG. 5), a rubber bushing 37 and a plug cover 39.

The socket member 29 includes sockets 50 which are fitted and soldered to the external wirings 23b as well as a socket tube 51, resin 52 filling the space between the sockets 50 and the socket tube 51, a fastening nut 53 and an O-ring 55 compressed between the pivot 9 and the socket tube 51.

Assembly is as follows.

Figure 4:
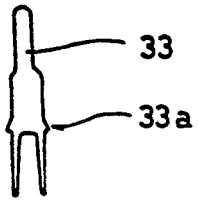
FIG. 4 is a plan of a plug.
Figure 7:
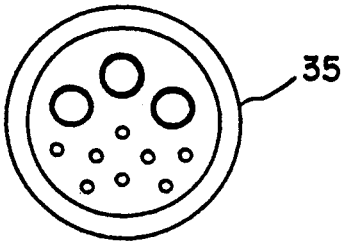
FIG. 7 is a plan of a plug guide of an embodiment of the invention.

(1) First, prior to fitting of the stator 12c into the casing 13, the plugs 33 are fitted and soldered to the respective internal wirings 23a, and are inserted into and are held by the plug guide 35 shown in FIG. 7. Each plug 33 is provided, as shown in FIG. 4, at its middle portion with a tapered flange 33a for preventing extraction thereof from the plug guide 35. The flange 33a may be a projection which projects horizontally or laterally.

(2) The stator 12c is fitted into the casing 13, and the plug guide 35 is taken out through the hole in the casing 13.

Figure 5:
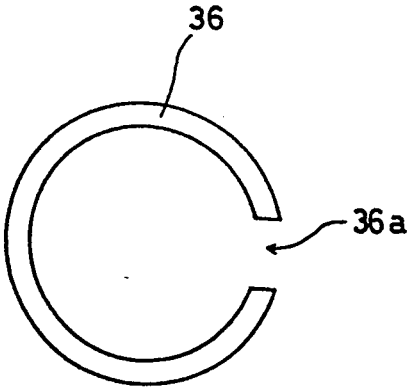
FIG. 5 is a plan of a C-ring.

(3) The internal wirings 23a are extended through a recess 36a in the C-ring 36 shown in FIG. 5 so as to prevent dropping of the plug guide 35 through the hole in the casing 13 into the motor 12.

(4) The rubber bushing 37 and the plug cover 39 are fixed to the casing 13 by bolts 56.

(5) The socket 50 is fitted to the plug 33, and the socket tube 51 is fastened by the fastening nut 53.

Figure 6:
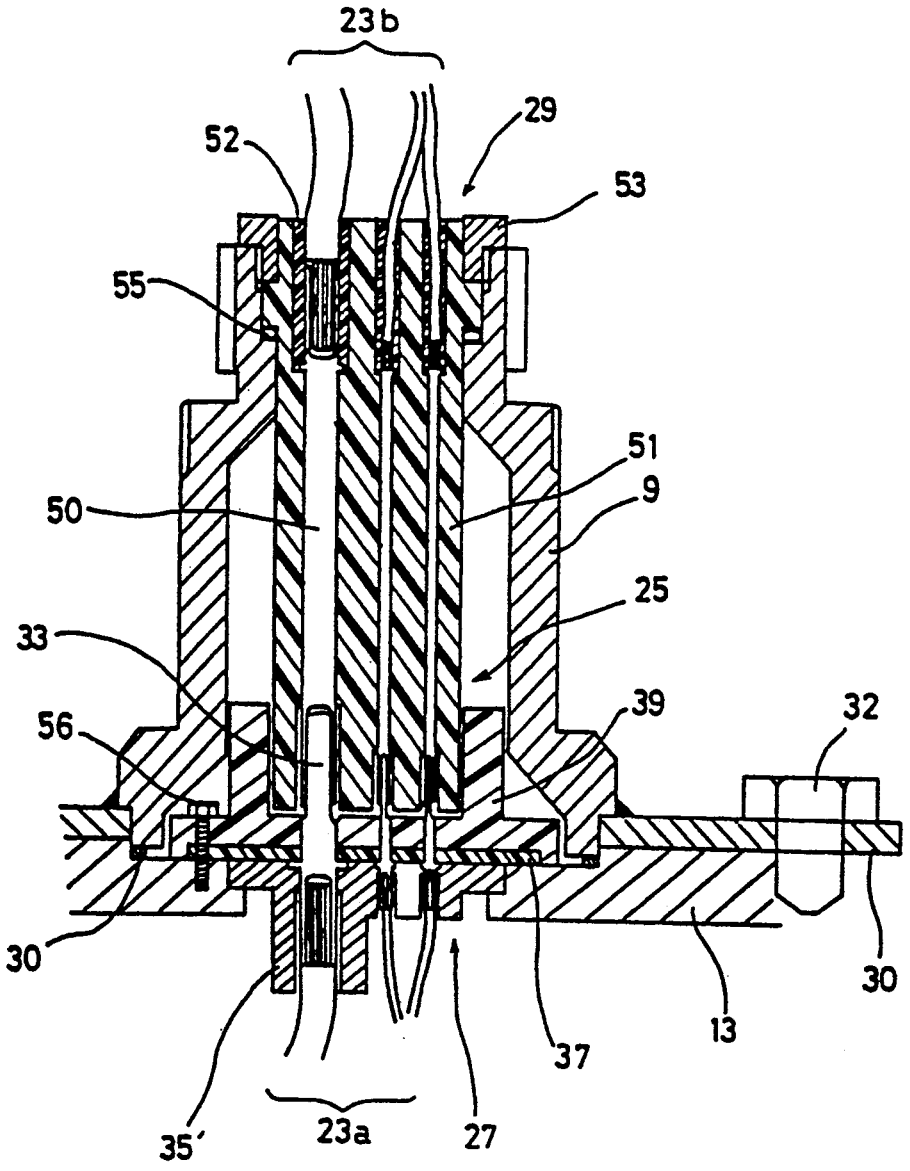
FIG. 6 is a cross section illustrating another embodiment of the invention.

Another embodiment of the invention will be described below with reference to FIG. 6. Members and parts same as those in the embodiment in FIG. 1 bear same reference numbers and will not be described below.

Figure 1:
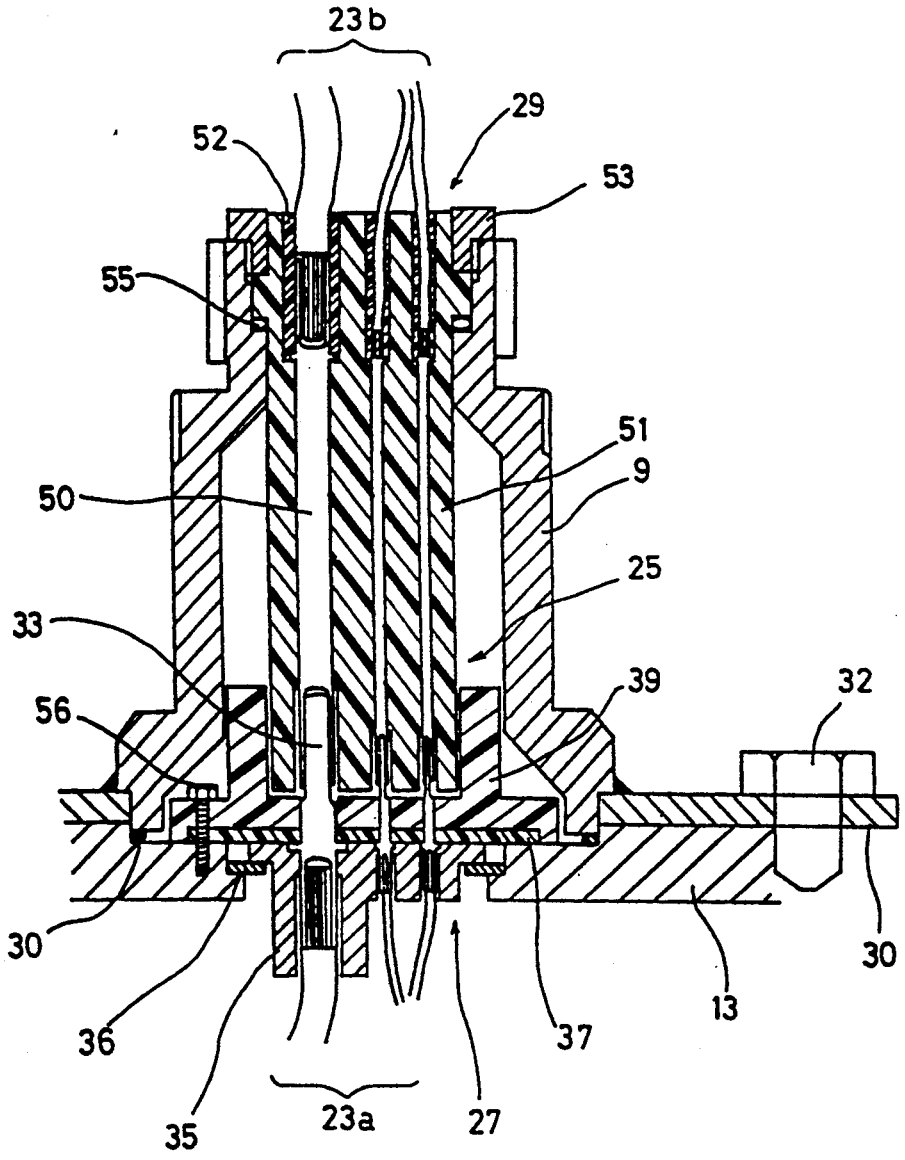
FIG. 1 is a cross section illustrating a wiring connection structure for a vehicle motor of an embodiment of the invention.
Figure 8:
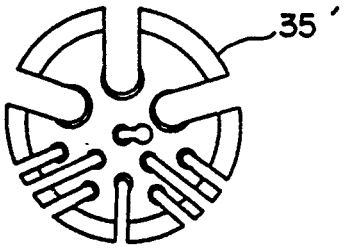
FIG. 8 is a plan of a plug guide of another embodiment.

In this embodiment, the C-ring 36 in FIG. 1 is eliminated and a plug guide 35' shown in FIG. 8 is directly fixed to the casing 13. In this embodiment, after fitting the stator 12c into the casing 13, the plug 33 is taken out through the hole in the casing 13, and each plug 33 is held by laterally inserting it into the corresponding apertures in the plug guide 35' extending beyond the casing 13.

Although particular preferred embodiments of the invention have been disclosed in detail for illustrative purposes, it will be recognized that other variations or modifications may be made without departing from the spirit and scope of the invention as claimed.

What is claimed is:

1. A wiring connection structure for connecting wiring internal to the casing of a vehicle electric motor to vehicle wiring external to the motor casing, wherein the electric motor is supported on a vehicle through a support member fixed to the casing, said wiring connection structure comprising:

a plug member attached to the casing and including a plug connected to the internal wiring, a plug guide for holding said plug, a rubber bushing for sealing the interior of said casing from the exterior thereof and a plug cover;

a C-ring attaching said plug guide to the casing; and a socket member fitted into the support member and mated with said plug, said socket member including a socket connected to external wiring and a socket tube for holding said socket.

2. A wiring connection structure for a vehicle motor as claimed in claim 1, wherein O-rings are compressed between said support member and said casing and between said support member and said socket tube, respectively.

3. A wiring connection structure for a vehicle motor as claimed in claim 1, wherein said motor is a wheel motor, and said support member is a pivot for said wheel motor.

* * * * *